US005564960A

United States Patent [19]

Underhill, Jr.

[11] Patent Number: 5,564,960

[45] Date of Patent: Oct. 15, 1996

[54] TOY BED AND BANK APPARATUS

[76] Inventor: Dennis A. Underhill, Jr., P.O. Box 831, 202 S. Ohio, Lavern, Okla. 73848

[21] Appl. No.: 443,730

[22] Filed: May 18, 1995

[51] Int. Cl.[6] ..... A45C 1/12; A63H 3/52

[52] U.S. Cl. ..... 446/8; 446/482

[58] Field of Search ..... 446/8–13, 482; 232/4 R, 1 D

[56] References Cited

U.S. PATENT DOCUMENTS

| | | | |
|---|---|---|---|
| D. 162,043 | 2/1951 | Langer et al. | 446/8 X |
| 3,745,596 | 7/1973 | Copeland . | |
| 3,992,805 | 11/1976 | Arkin | 446/8 |
| 4,103,375 | 8/1978 | Santo . | |
| 4,521,928 | 6/1985 | Stephenson . | |
| 4,811,438 | 3/1989 | Simpson . | |
| 4,901,383 | 2/1990 | Yang et al. . | |
| 5,099,529 | 3/1992 | Anderson . | |
| 5,291,624 | 3/1994 | Strobel . | |

*Primary Examiner*—Mickey Yu

[57] ABSTRACT

A toy bed and bank apparatus includes a first mattress support assembly, a plurality of drawers supported by the first mattress support assembly, and a second mattress support assembly selectively connected to or disconnected from the first mattress support assembly. The second mattress support assembly includes a hollow storage chamber and an access opening for gaining access to the storage chamber. A head board assembly is connected to the second mattress support assembly. The head board assembly includes a hollow coin-receiver chamber which is in communication with the storage chamber in the second mattress support assembly. The head board assembly includes a coin slot in communication with the coin-receiver chamber. A mattress assembly is adapted for placement upon the first mattress support assembly and the second mattress support assembly. The coin-receiver chamber includes a downwardly-sloping region which facilitates movement of coins from the head board assembly to the storage chamber of the second mattress support assembly. A cover covers the access opening for the storage chamber in the second mattress support assembly. The head board assembly includes a mirror assembly. The head board assembly includes a shelf located below the mirror assembly. The head board assembly includes a storage box supported by the shelf. The first mattress support assembly includes a first connector, the second mattress support assembly includes a second connector, and the first connector and the second connector are selectively engageable and disengageable.

14 Claims, 4 Drawing Sheets

TOY BED AND BANK APPARATUS

BACKGROUND OF THE INVENTION

1. Field of the Invention

The present invention relates generally to toys and, more particularly, to toy beds.

2. Description of the Prior Art

Toys are often miniature simulations of life size objects. In this context, toy beds are well known. They are especially useful when used in conjunction with toy dolls. Real beds generally have a mattress and an underlying support for the mattress. The underlying mattress support is often a box spring and a bed frame. Bed frames are known to include storage compartments such as disclosed in U.S. Pat. Nos. 3,745,596, 4,811,438, and 5,099,529. U.S. Pat. No. 4,103,375 discloses a waterbed that has decorative features on the side of the waterbed that simulate storage drawers. The following additional patents disclose frame devices for waterbeds: U.S. Pat. Nos. 4,521,928; 4,901,383; and 5,291,624. In view of the above, it would be desirable if a toy bed included simulated storage drawers, a simulated mattress, and a simulated mattress support.

Many real beds also include head boards. In this respect, it would be desirable if a toy bed included a simulated head board.

Still other features would be desirable in a toy bed apparatus. A toy need not merely simulate structures and functions of a real object. In fact, the toy can be endowed with characteristics that are not even present in the real object. In this respect, a toy bed can have characteristics that are not present in real beds. To encourage a child to groom a toy doll, it would be desirable if a head board on a toy bed included a mirror. For example, to encourage the habit of saving money, it would be desirable if a toy bed also included a bank.

Some kinds of toy savings banks are designed in such a fashion that, in order to remove the contents, the bank must be broken apart and destroyed. However, to encourage consistent saving, it would be desirable if a toy bed included a bank that can be readily emptied without destroying the bank.

In a real bed, a head board may include a shelf for storage of various items. In this respect, it would be desirable if a toy bed were provided with a head board that includes a storage shelf.

Thus, while the foregoing body of prior art indicates it to be well known to use toy beds, the prior art described above does not teach or suggest a toy bed apparatus which has the following combination of desirable features: (1) includes simulated storage drawers, a simulated mattress, and a simulated mattress support; (2) includes a simulated head board; (3) includes a mirror; (4) includes a bank; (5) includes a bank that can be readily emptied without destroying the bank; and (6) includes a head board that includes a storage shelf. The foregoing desired characteristics are provided by the unique toy bed and bank apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a toy bed and bank apparatus which includes a first mattress support assembly, a plurality of drawers supported by the first mattress support assembly, and a second mattress support assembly selectively connected to or disconnected from the first mattress support assembly. The second mattress support assembly includes a hollow storage chamber and an access opening for gaining access to the storage chamber. A head board assembly is connected to the second mattress support assembly. The head board assembly includes a hollow coin-receiver chamber which is in communication with the storage chamber in the second mattress support assembly. The head board assembly includes a coin slot in communication with the coin-receiver chamber. A mattress assembly is adapted for placement upon the first mattress support assembly and the second mattress support assembly. The coin-receiver chamber includes a downwardly-sloping region which facilitates movement of coins from the head board assembly to the storage chamber of the second mattress support assembly. A cover covers the access opening for the storage chamber in the second mattress support assembly. The head board assembly includes a mirror assembly. The head board assembly includes a shelf located below the mirror assembly. The head board assembly includes a storage box supported by the shelf.

The first mattress support assembly includes a first connector, the second mattress support assembly includes a second connector, and the first connector and the second connector are selectively engageable and disengageable. The first connector may include a two-stage slot. The two-stage slot includes a head-receiving aperture portion and a head-locking slot portion in communication with the head-receiving aperture portion. The second connector includes a neck portion connected to the second mattress support assembly and a head portion connected to the neck portion.

In accordance with another aspect of the invention, a guard assembly is provided which includes a first guard portion and a second guard portions oriented at right angles to the first guard portion. A portion of the first guard portion is sandwiched between a top surface of the first mattress support assembly and a bottom surface of the mattress assembly.

The mattress assembly has a mattress width. The first mattress support assembly has a support width, and the mattress width is greater than the support width. In this way, the mattress assembly includes mattress overhang portions which extend over the first mattress support assembly. Portions of the first guard portion extend beyond the top surface of the first mattress support assembly and cover bottom portions of the mattress overhang portions. In addition, portions of the second guard portions cover end portions of the mattress overhang portions.

In addition, first rail portions are connected to upper edge portions of the second guard portions. Also, a second rail portion is connected between a pair of the first rail portions.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toy bed and bank apparatus which has all of the advantages of the prior art and none of the disadvantages.

It is another object of the present invention to provide a new and improved toy bed and bank apparatus which may be easily and efficiently manufactured and marketed.

It is a further object of the present invention to provide a new and improved toy bed and bank apparatus which is of durable and reliable construction.

An even further object of the present invention is to provide a new and improved toy bed and bank apparatus which is susceptible of a low cost of manufacture with regard to both materials and labor, and which accordingly is then susceptible of low prices of sale to the consuming public, thereby making such toy bed and bank apparatus available to the buying public.

Still yet a further object of the present invention is to provide a new and improved toy bed and bank apparatus which includes simulated storage drawers, a simulated mattress, and a simulated mattress support.

Still another object of the present invention is to provide a new and improved toy bed and bank apparatus that includes a simulated head board.

Yet another object of the present invention is to provide a new and improved toy bed and bank apparatus which includes a mirror.

Even another object of the present invention is to provide a new and improved toy bed and bank apparatus that includes a bank.

Still a further object of the present invention is to provide a new and improved toy bed and bank apparatus which includes a bank that can be readily emptied without destroying the bank.

Yet another object of the present invention is to provide a new and improved toy bed and bank apparatus that includes a head board that includes a storage shelf.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
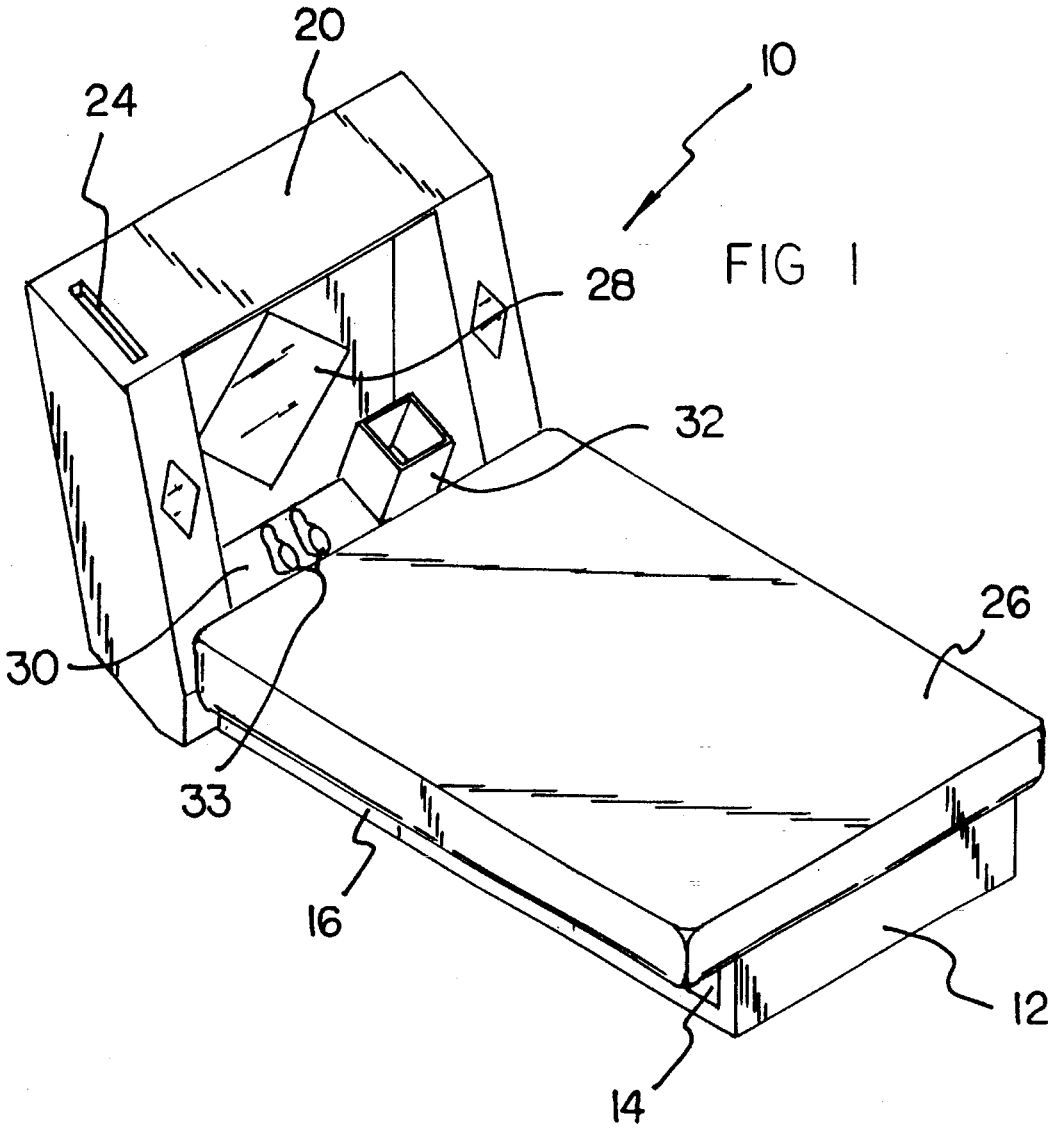
FIG. 1 is a perspective view showing a first embodiment of the toy bed and bank apparatus of the invention.
Figure 2:
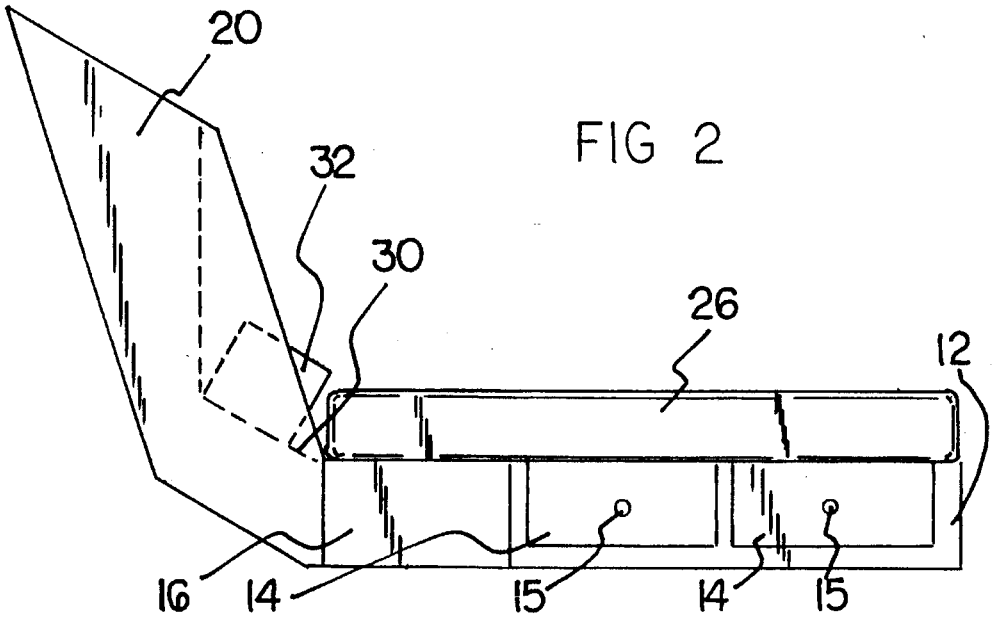
FIG. 2 is a side: view of the embodiment of the toy bed and bank apparatus shown in FIG. 1.
Figure 3:
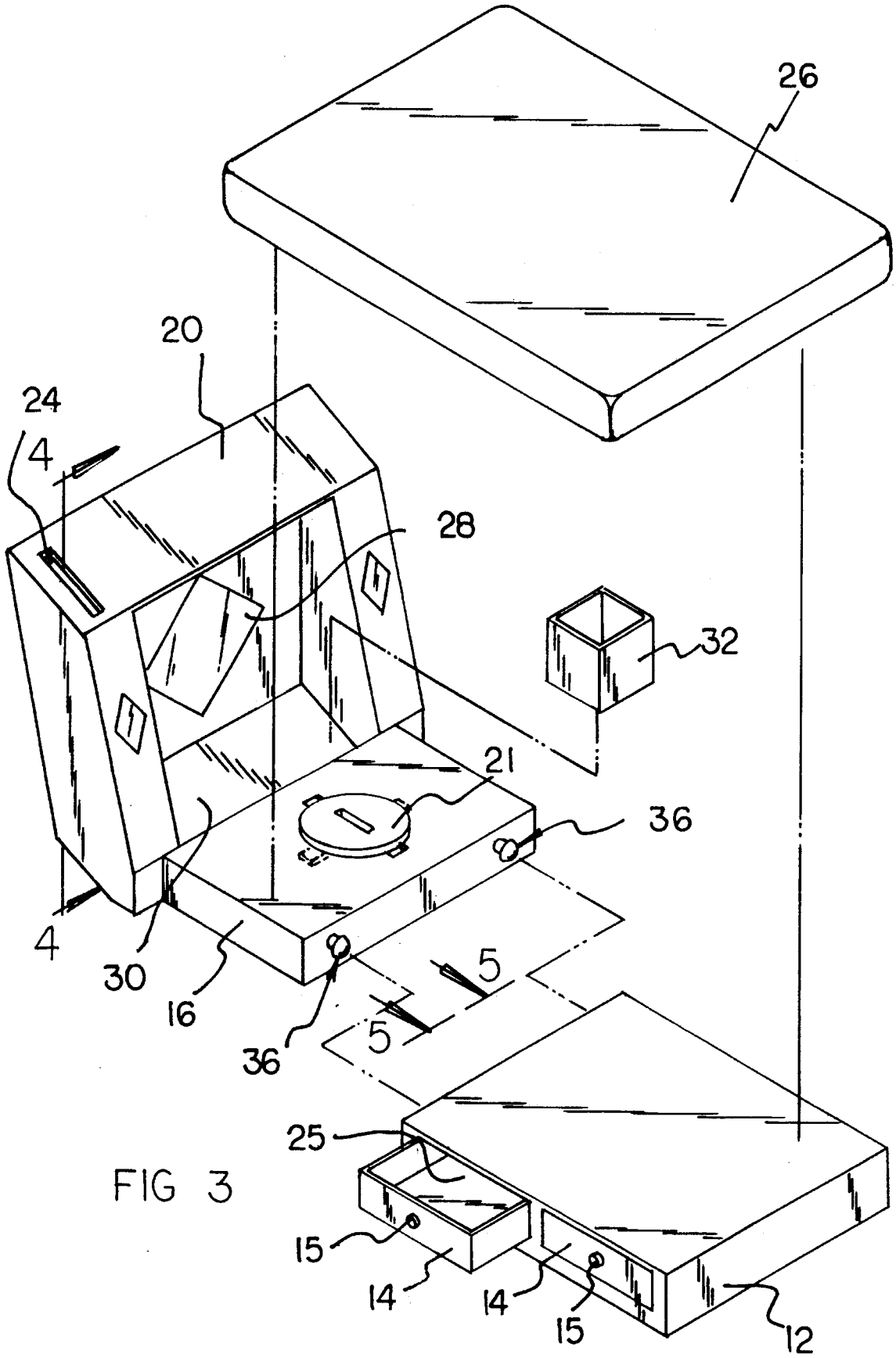
FIG. 3 is an exploded perspective view of the embodiment of the toy bed and bank apparatus of FIGS. 1 and 2.
Figure 4:
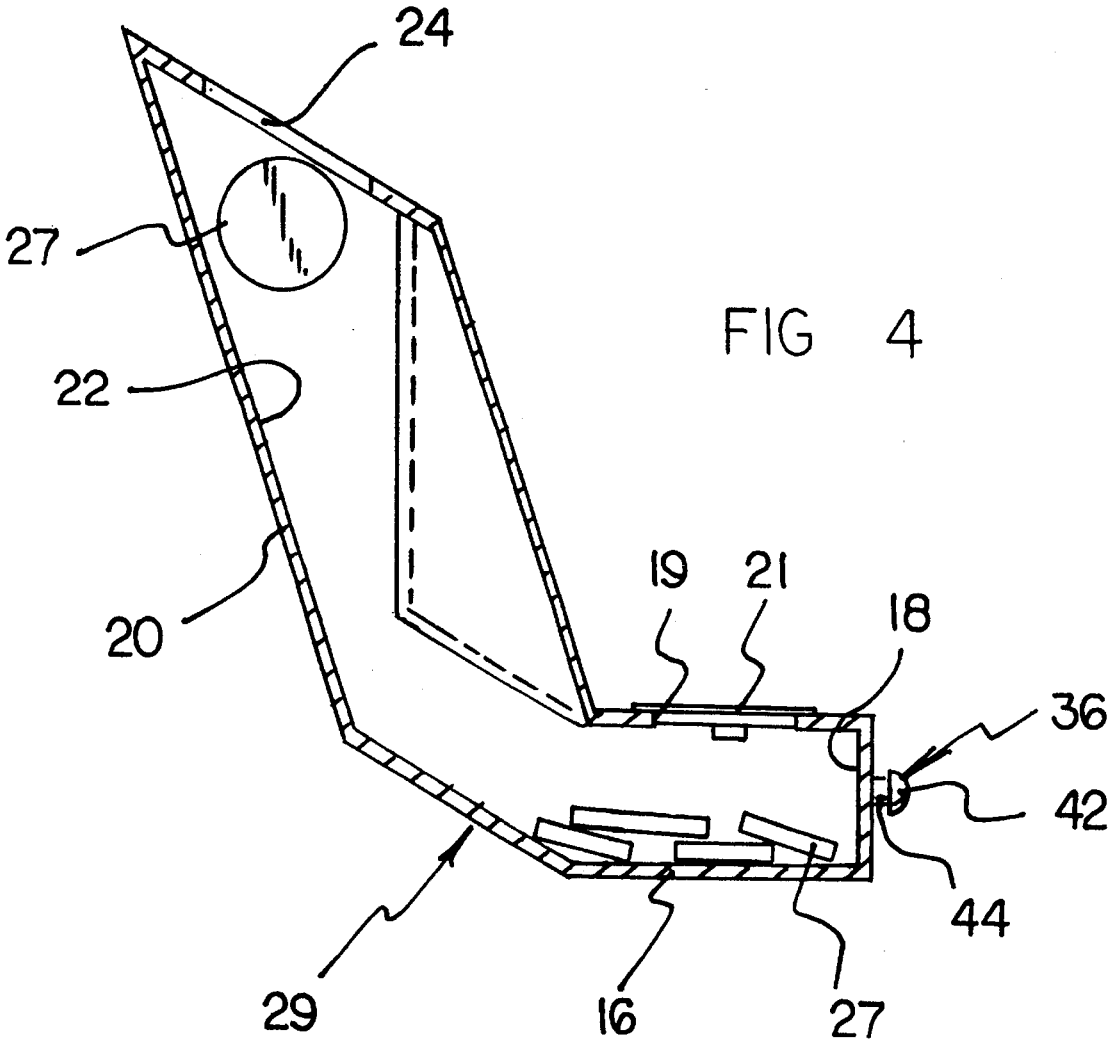
FIG. 4 is an enlarged cross-sectional view of a portion of the embodiment of the invention shown in FIG. 3 taken along line 4—4 thereof.
Figure 5:
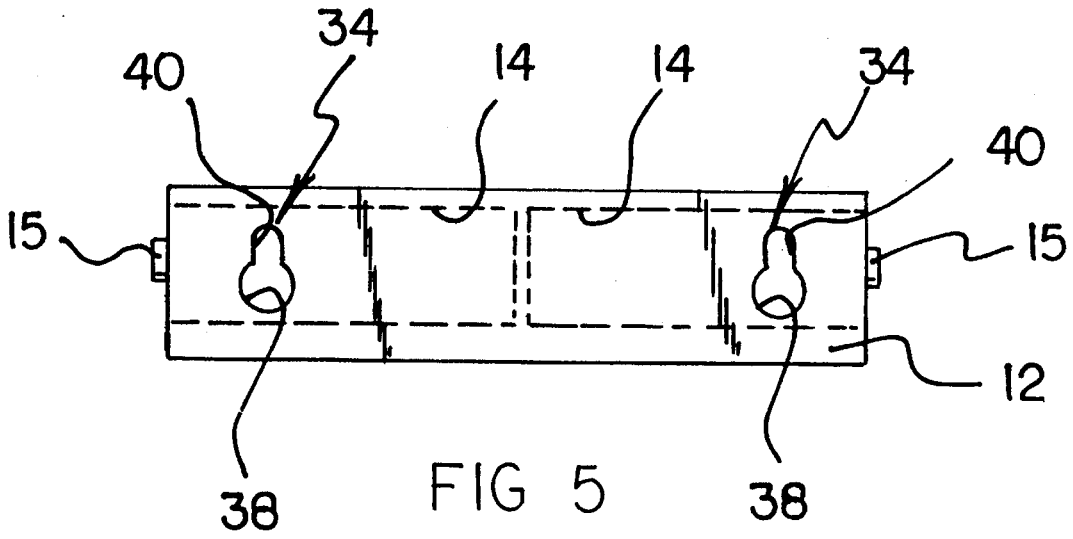
FIG. 5 is an enlarged frontal view of a portion of the embodiment of the invention shown in FIG. 3 taken along line 5—5 thereof.

With reference to the drawings, a new and improved toy bed and bank apparatus embodying the principles and concepts of the present invention will be described.

Turning to FIGS. 1–5, there is shown a first embodiment of the toy bed and bank apparatus of the invention generally designated by reference numeral 10. In its preferred form, toy bed and bank apparatus 10 includes a first mattress support assembly 12, a plurality of drawers 14 supported by the first mattress support assembly 12, and a second mattress support assembly 16 selectively connected to or disconnected from the first mattress support assembly 12. The second mattress support assembly 16 includes a hollow storage chamber 18 and an access opening 19 for gaining access to the storage chamber 18. A head board assembly 20 is connected to the second mattress support assembly 16. The head board assembly 20 includes a hollow coin-receiver chamber 22 which is in communication with the storage chamber 18 in the second mattress support assembly 16. The head board assembly 20 includes a coin slot 24 in communication with the coin-receiver chamber 22. A mattress assembly 26 is adapted for placement upon the first mattress support assembly 12 and the second mattress support assembly 16. The mattress assembly 26 can simulate a conventional spring mattress or a waterbed mattress. The coin-receiver chamber 22 includes a downwardly-sloping region 29 which facilitates movement of coins 27 from the head board assembly 20 to the storage chamber 18 of the second mattress support assembly 16. A cover 21 covers the access opening 19 for the storage chamber 18 in the second mattress support assembly 16. The coin slot 24, the coin-receiver chamber 22 of the head board assembly 20, and the storage chamber 18, the access opening 19, and the cover 21 of the second mattress support assembly 16 together form a bank assembly.

The drawers 14 includes handles 15. The head board assembly 20 includes a mirror assembly 28. The head board assembly 20 includes a shelf 30 located below the mirror assembly 28. The head board assembly 20 includes a storage box 32 supported by the shelf 30.

The first mattress support assembly 12 includes a first connector 34, the second mattress support assembly 16 includes a second connector 36, and the first connector 34 and the second connector 36 are selectively engageable and disengageable.

The first connector 34 includes a two-stage slot. The two-stage slot includes a head-receiving aperture portion 38 and a head-locking slot portion 40 in communication with the head-receiving aperture portion 38. The second connector 36 includes a neck portion 44 connected to the second mattress support assembly 16 and a head portion 42 connected to the neck portion 44. The toy bed and bank apparatus 10 of the invention is assembled by connecting a pair of first connectors 34 on the first mattress support assembly 12 to a complementary pair of second connectors 36 on the second mattress support assembly 16.

More specifically, the head portion 42 of each second connector 36 is inserted through the respective head-receiving aperture portion 38 of the respective first connector 34. Then, the first mattress support assembly 12 is translated downward with respect to the second mattress support assembly 16. When this is done, the neck portion 44 of the second connector 36 slides into the head-locking slot portion 40 of the first connector 34, and the head portion 42 of the second connector 36 is locked by the head-locking slot portion 40. When the first mattress support assembly 12 and the second mattress support assembly 16 interlocked, the mattress assembly 26 is placed over the interlocked first and second mattress support assemblies. The head board assembly 20 is integrally is connected to the second mattress support assembly 16. Therefore, when the second mattress support assembly 16 is connected to the first mattress support assembly 12, the head board assembly 20 is simultaneously properly placed in the invention. The storage box 32 is then placed on the shelf 30, and the drawers 14 are inserted in the drawer-receiving portions 25 of the first mattress support assembly 12. In FIG. 1, a pair of shoes 33 are shown resting on the shelf 30. The mirror assembly 28 had been previously attached to the head board assembly 20.

In operating the bank features of the toy bed and bank apparatus 10 of the invention, one or more coins 27 are inserted through the coin slot 24 to enter the coin-receiver chamber 22 of the head board assembly 20. The coins 27 fall under the influence of gravity into the storage chamber 18 of the second mattress support assembly 16 which is communication with the coin-receiver chamber 22. When the storage chamber 18 is to be emptied of coins 27, the mattress assembly 26 is first removed from the first mattress support assembly 12 and the second mattress support assembly 16. Then, the neck portion 44 of the second connector 36 is translated downward with respect to the head-locking slot portion 40 of the first connector 34, and the head portion 42 of the second connector 36 is passed out of the head-receiving aperture portion 38 of the first connector 34 to release the second mattress support assembly 16 from the first mattress support assembly 12. Then, the cover 21 of the access opening 19 to the storage chamber 18 is removed, the head board assembly 20 and second mattress support assembly 16 are turned upside down, and the coins 27 are permitted to fall out from the storage chamber 18 through the open access opening 19. After the coins 27 are emptied from the storage chamber 18, the cover 21 is repositioned to cover the access opening 19. Then, the second mattress support assembly 16 is reconnected to the first mattress support assembly 12, and the mattress assembly 26 is replaced in position over the first mattress support assembly 12 and the second mattress support assembly 16.

The mattress assembly 26 can be either a conventional spring-containing mattress or a water bed mattress.

Figure 7:
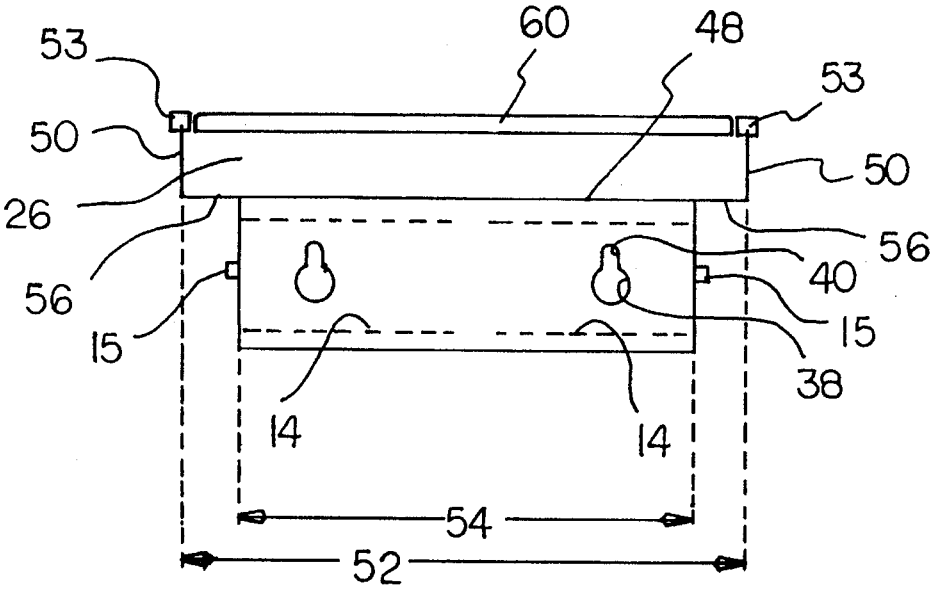
FIG. 7 is a cross-sectional view of the embodiment of the invention shown in FIG. 6 taken along line 7—7 thereof.
Figure 6:
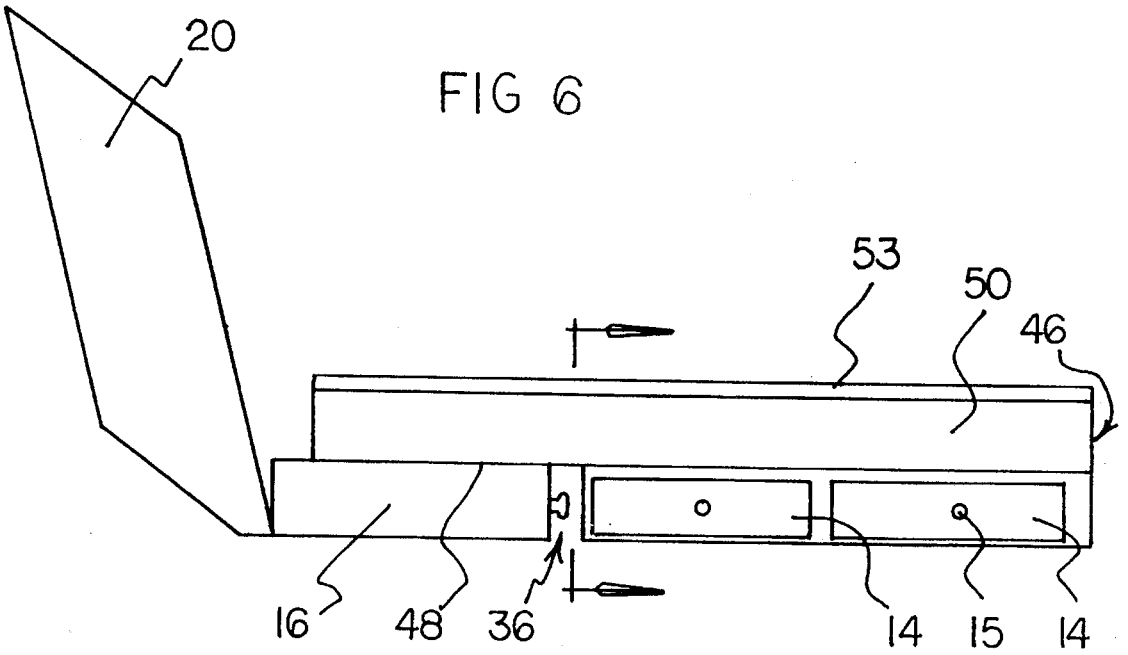
FIG. 6 is a side view of a second embodiment of the invention which includes guard assemblies and rail portions.

Turning to FIGS. 6 and 7, a guard assembly 46 is provided which includes a first guard portion 48 and a second guard portions 50 oriented at fight angles to the first guard portion 48. A portion of the first guard portion 48 is sandwiched between a top surface of the first mattress support assembly 12 and a bottom surface of the mattress assembly 26.

The mattress assembly 26 has a mattress width 52. The first mattress support assembly 12 has a support width 54, and the mattress width 52 is greater than the support width 54. In this way, the mattress assembly 26 includes mattress overhang portions 56 which extend over the first mattress support assembly 12. Portions of the first guard portion 48 extend beyond the top surface of the first mattress support assembly 12 and cover bottom portions of the mattress overhang portions 56. In addition, portions of the second guard portions 50 cover end portions of the mattress overhang portions 56.

In addition, first rail portions 53 are connected to upper edge portions of the second guard portions 50. Also, a second rail portion 60 is connected between a pair of the first rail portions 53.

The components of the toy bed and bank apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved toy bed and bank apparatus that is low in cost, relatively simple in design and operation, and which includes simulated storage drawers, a simulated mattress, and a simulated mattress support. With the invention, a toy bed and bank apparatus is provided which includes a simulated head board. With the invention, a toy bed and bank apparatus is provided which includes a mirror. With the invention, a toy bed and bank apparatus is provided which includes a bank. With the invention, a toy bed and bank apparatus is provided which includes a bank that can be readily emptied without destroying the bank. With the invention, a toy bed and bank apparatus is provided which includes a head board that includes a storage shelf.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A toy bed and bank apparatus, comprising:

a first mattress support assembly, a plurality of drawers supported by said first mattress support assembly, a second mattress support assembly selectively connected to or disconnected from said first mattress support assembly, wherein said second mattress support assembly includes a hollow storage chamber and an access opening for gaining access to said storage chamber, a head board assembly connected to said second mattress support assembly, wherein said head board assembly includes a hollow coin-receiver chamber which is in communication with said storage chamber in said second mattress support assembly, wherein said head board assembly includes a coin slot in communication with said coin-receiver chamber, and a mattress assembly adapted for placement upon said first mattress support assembly and said second mattress support assembly.

2. The apparatus of claim 1 wherein said coin-receiver chamber includes a downwardly-sloping region which facilitates movement of coins from said head board assembly to said storage chamber of said second mattress support assembly.

3. The apparatus of claim 1, further including:

a cover for covering said access opening for said storage chamber in said second mattress support assembly.

4. The apparatus of claim 1 wherein said head board assembly includes a mirror assembly.

5. The apparatus of claim 4 wherein said head board assembly includes a shelf located below said mirror assembly.

6. The apparatus of claim 5 wherein said head board assembly includes a box supported by said shelf.

7. The apparatus of claim 1 wherein:

said first mattress support assembly includes a first connector, said second mattress support assembly includes a second connector, and said first connector and said second connector are selectively engageable and disengageable.

8. The apparatus of claim 7 wherein:

said first connector includes a two-stage slot, wherein said two-stage slot includes a head-receiving aperture portion and a head-locking slot portion in communication with said head-receiving aperture portion, and said second connector includes a neck portion connected to said second mattress support assembly and a head portion connected to said neck portion.

9. The apparatus of claim 1, further including:

a guard assembly which includes a first guard portion and a second guard portions oriented at right angles to said first guard portion, wherein a portion of said first guard portion is sandwiched between a top surface of said first mattress support assembly and a bottom surface of said mattress assembly.

10. The apparatus of claim 9 wherein:

said mattress assembly has a mattress width, said first mattress support assembly has a support width, said mattress width is greater than said support width, whereby said mattress assembly includes mattress overhang portions which extend over said first mattress support assembly, portions of said first guard portion extend beyond said top surface of said first mattress support assembly and cover bottom portions of said mattress overhang portions, and portions of said second guard portions cover end portions of said mattress overhang portions.

11. The apparatus of claim 10, further including:

first rail portions connected to upper edge portions of said second guard portions.

12. The apparatus of claim 11, further including a second rail portion connected between a pair of said first rail portions.

13. The apparatus of claim 1 wherein said mattress assembly is a spring-containing mattress.

14. The apparatus of claim I wherein said mattress assembly is a water bed mattress.

* * * * *